US006831255B1

(12) United States Patent
Levi et al.

(10) Patent No.: US 6,831,255 B1
(45) Date of Patent: Dec. 14, 2004

(54) COMBINATION RADIANT/CONVECTION COOKING SYSTEM FOR AN ELECTRIC OVEN

(75) Inventors: David E. Levi, Ringgold, GA (US); Mark A. Pickering, Cleveland, TN (US); Lloyd A. Smith, Jr., Charleston, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/659,322

(22) Filed: Sep. 11, 2003

(51) Int. Cl.[7] ..... A21B 1/14; A21B 1/26

(52) U.S. Cl. ..... 219/400; 219/411; 219/407; 126/21 A

(58) Field of Search ..... 219/400, 406, 219/407, 411; 126/21 A

(56) References Cited

U.S. PATENT DOCUMENTS

| | | | | |
|---|---|---|---|---|
| 3,825,406 A | | 7/1974 | Heath | |
| 4,335,290 A | | 6/1982 | Teich | |
| 4,430,541 A | | 2/1984 | Day, Jr. | |
| 4,951,648 A | * | 8/1990 | Shukla et al. | 126/21 A |
| 5,620,623 A | | 4/1997 | Baker | |
| 5,676,870 A | | 10/1997 | Wassman et al. | |
| 5,697,360 A | * | 12/1997 | Cigarini et al. | 219/400 |
| 5,726,423 A | | 3/1998 | Westerberg et al. | |
| 5,958,271 A | * | 9/1999 | Westerberg et al. | 219/411 |
| 6,069,344 A | * | 5/2000 | Krasznai et al. | 219/400 |
| 6,114,664 A | | 9/2000 | Cook et al. | |
| 6,376,817 B1 | | 4/2002 | McFadden et al. | |
| 2002/0074323 A1 | | 6/2002 | De'Longhi | |

FOREIGN PATENT DOCUMENTS

| | | | |
|---|---|---|---|
| GB | 2179440 A | * | 3/1987 |
| WO | WO 88/01719 | | 3/1988 |

* cited by examiner

*Primary Examiner*—Joseph Pelham
(74) *Attorney, Agent, or Firm*—Diederiks & Whitelaw, PLC

(57) ABSTRACT

An electric oven includes a cabinet within which is arranged an oven cavity. Arranged below a bottom portion of the oven cavity is a combination convection/radiant bake cooking system adapted to derive heat energy from a single heat source. The oven preferably includes a central opening in the bottom portion within which is arranged a glass panel. Arranged about a periphery of the central opening are a plurality of vented openings adapted to introduce a convective airflow into the oven cavity. The glass panel provides both a conductive heat surface transmitting radiant heat energy into the oven cavity and a viewing surface allowing a consumer to view the operation of the heat source.

19 Claims, 2 Drawing Sheets

COMBINATION RADIANT/CONVECTION COOKING SYSTEM FOR AN ELECTRIC OVEN

BACKGROUND OF THE INVENTION

1. Field of the Invention

The present invention pertains to the art of cooking appliances and, more particularly, to an electric oven having a combination radiant/convection cooking system employing a common heat source located outside an oven cavity.

2. Discussion of the Prior Art

In general, electric ovens utilizing combination convection and radiant heat systems to perform a cooking process are well known in the art. In a typical arrangement, the convection system includes a fan assembly and an electric heat source arranged within a housing mounted either behind or above an oven cavity. In addition, a separate, radiant bake element is generally located in a lower region of the oven cavity. In order to achieve a combination radiant/convection cooking process, two distinct heating systems are employed to deliver heat into the oven cavity.

While utilizing two distinct systems to perform a cooking process has proven effective, there are several, associated disadvantages. Foremost, separate heating systems add to the overall complexity and cost of the oven. Increasing the number of heating elements increases the number of potential failure points in the system. Additionally, locating the systems in different regions of the electric oven requires routing supply and control wiring throughout substantial portions of the appliance. Separate heating systems also require additional space for ducting which, with modern systems, can limit the potential for adding other advantageous features to the oven. In the highly competitive field of household appliances, lowering production/sale costs, reducing the frequency of repair, and providing space for additional features will increase the attractiveness of the appliance to a consumer.

Finally, positioning the radiant bake element in the lower region of the oven cavity raises several other concerns. Mounting the bake element in an exposed portion of the oven cavity may lead to breakage caused by exposure to falling pans, dishes or the like. Additionally, food by-products released from cooking food items can accumulate on exterior surfaces of the element and, as a result, shorten the overall operational life of the element. Other problems arise when the element is mounted below a panel or false bottom in the oven cavity. Without being able to view the element in operation, i.e., see the element glow, a consumer may not be aware that the element has failed. When two distinct systems are in use, the consumer may mistakenly believe that the cooking process is being performed with heat derived from both systems when, in actuality, the heat is being supplied solely from one system or the other. If this was to occur, the quality of the cooking process would be reduced and, left unaware, the consumer may not know that a repair was necessary.

Based on the above, there exists a need in the art for a combination radiant/convection electric oven which utilizes a single heat source for both radiant and convection cooking. Moreover, there exists a need for an oven that positions the heat source in a manner which protects the heat source from exposure to a harsh oven environment, while enabling the consumer to view the heat source in operation.

SUMMARY OF THE INVENTION

The present invention is directed to a combination radiant/convection electric oven including a cabinet within which is arranged an oven cavity. Specifically, the oven includes a combination convection/radiant bake cooking system having an electric heating element and a convection fan or blower assembly arranged below a bottom wall of the oven cavity. More specifically, the electric heating element includes a central portion within which is positioned the convection fan. With this arrangement, the electric heating element serves as both a radiant heat source and as a convective heat source for the cooking system.

In accordance with a preferred embodiment, the cooking system is positioned below a central opening formed in the bottom wall of the oven cavity. A glass panel is positioned in the central opening. A plurality of convection air vents are also provided in the bottom wall to direct a convective airflow from the cooking system to the oven cavity. In the most preferred embodiment, the glass panel is formed from CERAN glass which enables at least a portion of the heat energy generated by the electric heating element to be introduced into the oven cavity in the form of radiant heat which combines with the convection heat flow to perform an overall cooking process. In further accordance with this preferred embodiment, the CERAN glass constitutes a window through which a consumer can view the heating element in operation.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
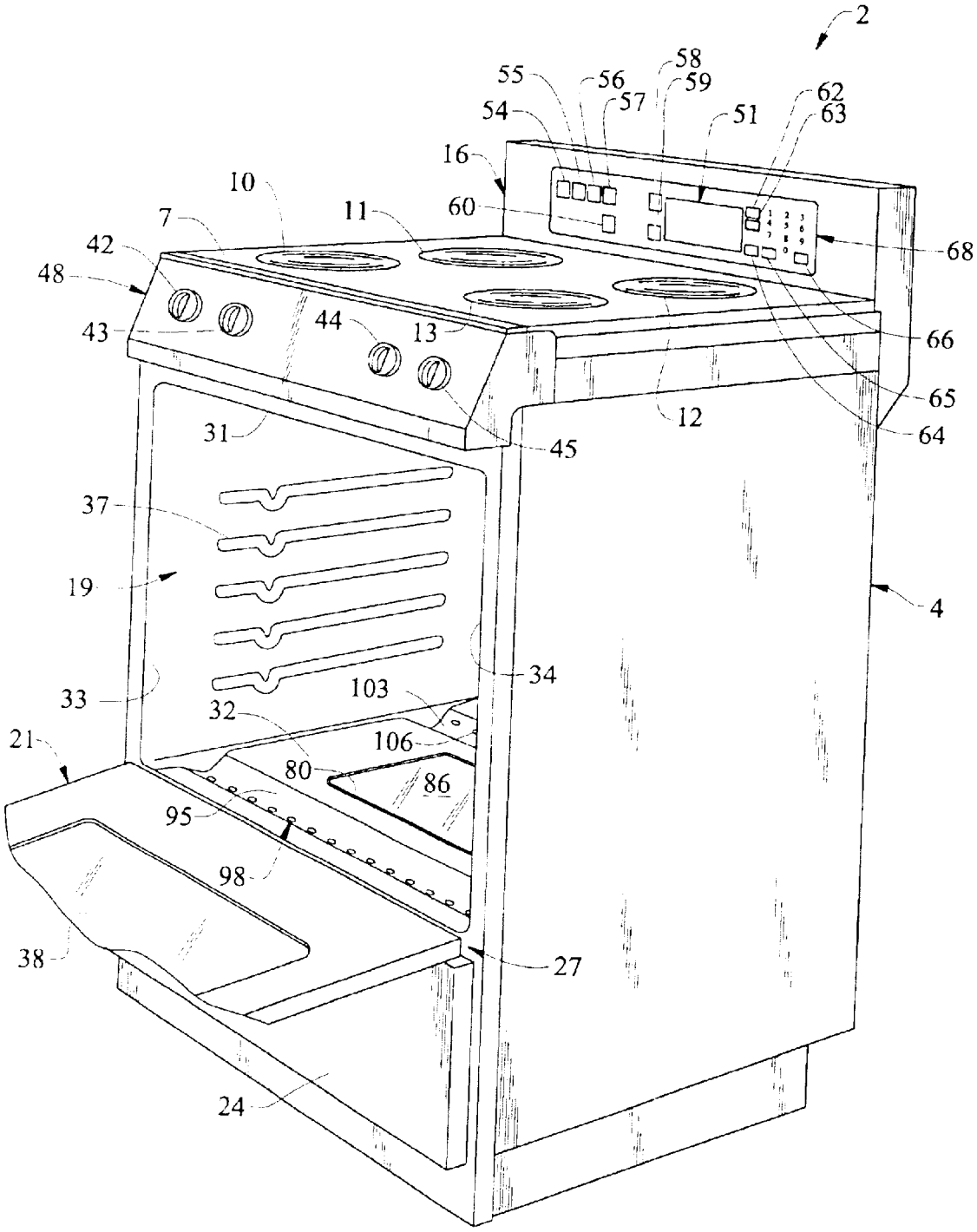
FIG. 1 is a perspective view of an oven range incorporating a combination radiant/convection cooking system constructed in accordance with the present invention.

With initial reference to FIG. 1, a cooking appliance 2, generally taking the form of a free-standing oven range, includes a cabinet 4 provided with a cooktop 7. As illustrated, appliance 2 constitutes an electric oven such that cooktop 7 is provided with a plurality of electric heating elements 10–13. At this point, it should be noted that although appliance 2 is shown to constitute a free standing electric range, the present invention is equally applicable to various other types of types of electric ovens, including slide-in ranges, wall ovens and the like.

In a manner known in the art, cooking appliance 2 includes a control panel 16, an interior oven cavity 19 having a door 21 associated therewith, and a lower drawer or bin 24. More specifically, drawer or bin 24 is adapted to be slid into and out of cabinet 4, in order to access an interior storage compartment (not shown) arranged therein. Door 21 is adapted to pivot at a lower portion 27 to enable selective access to within oven cavity 19. In a manner also known in the art, door 21 is provided with a transparent zone 38 for viewing oven cavity 19 while door 21 is closed. In the embodiment shown, oven cavity 19 includes at least a top panel 31, a bottom panel 32, opposing side panels 33 and 34, and a rear panel 35 (see FIG. 2). Arranged on side panels 33 and 34 are a plurality of vertically spaced and fore-to-aft extending baking rack support elements 37 for slidably receiving a food support rack (not shown).

A plurality of control knobs 42–45, for use in selectively activating and deactivating heating elements 10–13 respectively, are arranged on a front face portion 48 of cabinet 4. The heating of oven cavity 19 is preferably, electronically controlled, with control panel 16 including a display zone 51, as well as a set of control buttons 54–57 which enable a consumer to select a desired cooking operation, e.g., bake, convection bake, broil, or keep warm operations. In addition, an operational mode cancel button 58, a light activation button 59, and a self-clean button 60 are provided on one side of display zone 51. On the opposing side of display zone 51, there is provided an operating set button 62, a timer button 63, cook and stop time buttons 64 and 65, a clock button 66, and a numeric pad 68.

In general, the structure described above with respect to cooking appliance 2 is already known in the art and does not constitute part of the present invention. Therefore, this structure has only been described for the sake of completeness. Instead, the present invention is particularly directed to a combination radiant/convection cooking system adapted to establish a heated cooking environment within oven cavity 19.

Figure 2:
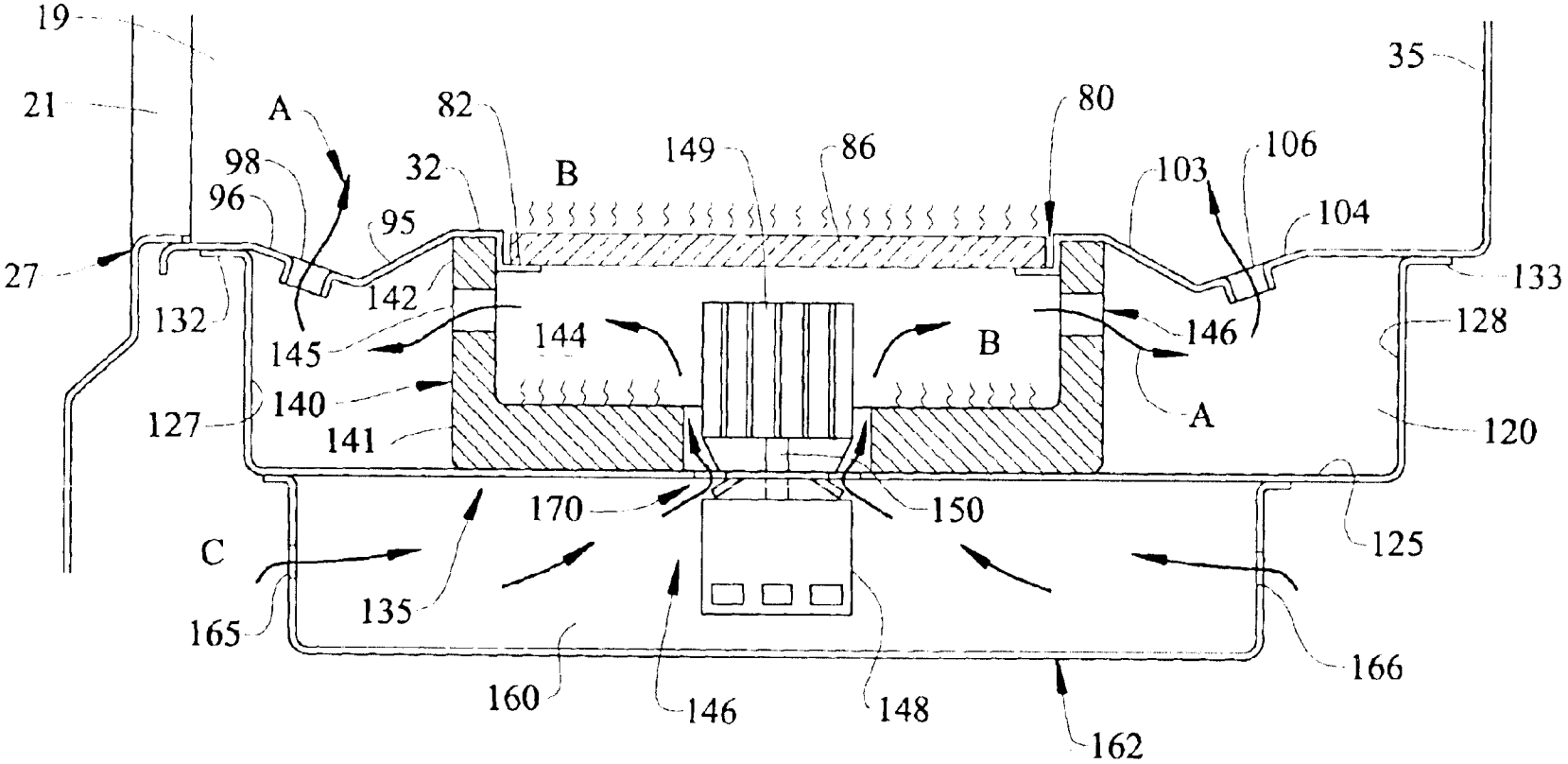
FIG. 2 is a partial cross-sectional view of the oven range of FIG. 1.

Referring to FIGS. 1 and 2, bottom panel 32 of oven cavity 19 includes a central opening 80. In the embodiment shown, central opening 80 is defined by an interior ledge portion 82 which supports a removable glass panel 86. More specifically, glass panel 86 is formed from a heat resistant, substantially transparent material, preferably a high temperature ceramic material such as CERAN. However, other materials having similar qualities are equally acceptable. Although the actual size and shape of opening 80 could vary, the preferred embodiment provides for a 12 inch×12 inch (approximately 30.5 cm×30.5 cm) opening 80.

Along a front peripheral portion of central opening 80, bottom panel 32 includes a downward and forward sloping portion 95 that leads to an upward and forward sloping portion 96. With this construction, a front depression (not separately labeled) is defined forward of central opening 80. Arranged in this front depression, specifically along sloping portion 96, are a plurality of front vent openings generally indicated at 98. Similarly, extending along a rear peripheral portion of central opening 80 is a downward and rearward sloping portion 103 that leads to an upward and rearward sloping portion 104. In a manner similar to that illustrated for sloping portion 95, a rear depression (not separately labeled) is formed in bottom panel 32 and a plurality of rear vent openings 106 are provided in sloping portion 104.

As best shown in FIG. 2, a heating chamber 120, having at least a bottom wall portion 125 and opposing front and rear wall portions 127 and 128, is secured to bottom panel 32 of oven cavity 19 through attachment flanges 132 and 133. Positioned within heating chamber 120 is a heating system 135 which, when activated, generates heat to be delivered into oven cavity 19. In the embodiment shown, heating system 135 includes a single electric heat source 140 having a lower portion 141 mounted on bottom wall portion 125 of heating chamber 120, and an upper portion 142 extending to bottom panel 32 of oven cavity 19. Lower portion 141 and upper portion 142 combine to define an interior central cavity or zone 144 having a plurality of laterally spaced, front and rear exit ports 145 and 146 respectively. In a preferred form of the invention, electric heat source 140 constitutes a high wattage heat block. However, other types of heaters, including standard sheathed electric resistance elements, as well as quartz elements of various wattage levels, could be employed. In accordance with this preferred embodiment, electric heat source 140 serves as both a source of radiant heat energy and, as will be detailed more fully below, a source of convective heat energy.

As indicated above, heating system 135 of cooking appliance 2 also includes a convective cooking system 146 which can be activated to perform a portion of an overall cooking process. As shown, convective cooking system 146 includes a fan motor 148 operatively connected to a blower 149 through a motor shaft 150. Fan motor 148 is positioned within an air intake plenum 160 defined by a basin 162 affixed to bottom wall portion 125. Air intake plenum 160, which includes a plurality of air inlet ports generally indicated at 165and 166, enables an incoming airflow to be directed into heating chamber 120 through a heating chamber inlet openings 170 arranged adjacent blower 149.

Having described a preferred construction of cooking appliance 2, a preferred method of operation will now be described. Assuming a combination bake/convection cooking operation is selected through control panel 68, electrical current is supplied to electric heat source 140. Upon activation, the temperature of electric heat source 140 begins to rise, resulting in a glowing effect which is visible through glass panel 86. As the temperature of heat source 140 rises, heat energy, generally indicated at B, is radiated into oven cavity 19 through bottom panel 32 and glass panel 86, thereby establishing a heated environment suitable to perform the desired cooking process.

Simultaneously, electrical energy is supplied to fan motor 148, thereby rotating blower 149 which develops convective air streams generally indicated at A. In addition to the radiant heat energy, electric heat source 140 supplies convective heat energy to convective air streams A. More specifically, as fan motor 148 operates, an incoming airflow C is drawn into intake air plenum 160 through the plurality of inlet ports 165 and 166. The incoming airflow C is subsequently drawn into interior portion 144 of electric heat source 140 through intake openings 170 where heat energy from electric heat source 140 is transferred, through a convective heat process, to the incoming airflow C to establish convective air streams A. At the same time, blower 149 drives convective air streams A from interior cavity 144 of electric heat source 140 through the plurality of exit ports 145 and 146. The convective air streams A travel into heating chamber 120 and, finally, into oven cavity 19 through front and rear inlet vent openings 98 and 106. In this manner, food item(s) placed in oven cavity 19 will be subjected to a combination radiant bake and convection cooking process. By employing both the radiant and convective heat operations, a uniform cooking environment is established and the cooking process can be performed in less time. Due to the locating of inlet vent openings 98 and 106 on sloping portions 96 and 104 respectively, the convection airflow is directed upward and centrally in oven cavity 19 in a manner which enhances the overall convection cooking process.

Although described with reference to a preferred embodiment of the present invention, it should be readily apparent to one of ordinary skill in the art that various changes and/or modifications can be made to the invention without departing from the spirit thereof. For instance, while the convective air inlet vent openings are shown extending adjacent front and rear portions of the glass panel, other arrangements, including having the vents extend entirely about or through the glass panel, could be employed. For instance, it would be possible to have substantially the entire bottom wall of the oven cavity defined by a glass plate with vent openings therein. In addition to radiant and convection cooking, a microwave system could be added to further reduce the overall time required to perform the cooking operation or to simply add additional versatility to cooking appliance 2. In general, the invention is only intended to be limited to the scope of the following claims.

We claim:

1. An electric cooking appliance employing a combination radiant/convection heating system comprising:

an oven cavity including a bottom portion having a central opening surrounded by a peripheral edge portion;

a glass panel positioned within the central opening;

a plurality of air inlet vents provided in and at least partially extending about the peripheral edge portion;

an electric heat source arranged below the glass panel and defining a central zone, said electric heat source being adapted to radiate heat through the glass panel into the oven cavity; and a convection blower assembly arranged within the central zone, said convection blower assembly being adapted to generate a convective airflow which passes the electric heat source and flows through the air inlet vents into the oven cavity, wherein said electric heat source produces heat for both radiant and convective heating of the oven cavity, with said electric heat source being visible, at least when activated, when looking into the oven cavity and through the glass panel.

2. An electric cooking appliance employing a combination radiant/convection heating system comprising:

an oven cavity including a bottom portion having a central opening surrounded by a peripheral edge portion;

a glass panel positioned within the central opening;

a plurality of air inlet vents at least partially extending about the oven cavity;

an electric heat source arranged below the glass panel, said electric heat source being adapted to radiate heat through the glass panel into the oven cavity; and a convection blower assembly adapted to generate a convective air flow which passes the electric heat source and flows through the air inlet vents into the oven cavity, wherein said electric heat source produces heat for both radiant and convective heating of the oven cavity.

3. The electric cooking appliance according to claim 2, wherein the glass panel is formed from a ceramic material.

4. The electric cooking appliance according to claim 2, wherein the glass panel is transparent such that said electric heat source is visible, at least when activated, when looking into the oven cavity and through the glass panel.

5. The electric cooking appliance according to claim 2, wherein the central opening is approximately 12"×12" (30.5 cm×30.5 cm) square.

6. The electric cooking appliance according to claim 2, wherein the electric heat source includes a central zone arranged below a glass panel, said convection blower assembly being arranged within the central zone.

7. The electric cooking appliance according to claim 2, wherein the bottom portion of the oven cavity includes sloping portions, said plurality of air inlet vents being arranged along the sloping portions.

8. The electric cooking appliance according to claim 7, wherein the sloping portions include a forward and upward sloping portion and a rearward and upward sloping portion.

9. An electric cooking appliance employing a combination radiant/convection heating system comprising:

an oven cavity including a bottom portion;

a plurality of air inlet vents provided in the bottom portion;

an electric heat source arranged below the bottom portion and defining a central zone, said electric heat source being adapted to radiate heat through the bottom portion into the oven cavity; and a convection blower assembly arranged within the central zone, said convection blower assembly being adapted to generate a convective airflow which passes the electric heat source and flows through the air inlet vents into the oven cavity, wherein said electric heat source produces heat for both radiant and convective heating of the oven cavity, with said electric heat source being visible, at least when activated, when looking into the oven cavity and through a section of the bottom portion.

10. The electric cooking appliance according to claim 9, further comprising:

a central opening formed in the bottom portion of the oven cavity; and a glass panel positioned within the central opening.

11. The electric cooking appliance according to claim 10, wherein the glass panel is formed from a ceramic material.

12. The electric cooking appliance according to claim 10, wherein the glass panel is transparent such that said electric heat source is visible, at least when activated, when looking into the oven cavity and through the glass panel.

13. The electric cooking appliance according to claim 10, wherein the central opening is approximately 12"×12" (30.5 cm×30.5 cm) square.

14. The electric cooking appliance according to claim 10, wherein bottom portion of the oven cavity further includes a peripheral edge portion extending about the central opening, said plurality of air inlet vents being arranged along the peripheral edge portion.

15. The electric cooking appliance according to claim 9, wherein the bottom portion of the oven cavity includes sloping portions, said plurality of air inlet vents being arranged along the sloping portions.

16. The electric cooking appliance according to claim 15, wherein the sloping portions include a forward and upward sloping portion and a rearward and upward sloping portion.

17. A method of introducing heat into an oven cavity having a bottom wall portion within which is arranged a glass panel comprising:

activating a heat source located below the glass panel to cause heat to be radiated through the glass panel and into the oven cavity;

operating a convection blower assembly positioned within a central portion of the heat source to cause a convective air stream to flow over and be heated by the heat source; and directing the convective air stream through a plurality of air inlet vents arranged about the glass panel.

18. The method of claim 17, further comprising: viewing the heat source in an activated state while looking into the oven cavity and through the glass panel.

19. The method of claim 17, further comprising: introducing the convective air stream upwardly and centrally into the oven cavity.

* * * * *